US008262982B2

(12) United States Patent
Leng et al.

(10) Patent No.: US 8,262,982 B2
(45) Date of Patent: Sep. 11, 2012

(54) APPARATUS FOR REMOVAL AND REPLACEMENT OF A HINGED LID ON A METALLURGICAL TRANSPORT VESSEL

(75) Inventors: Song Leng, Kitchener (CA); David Henry Rudge, Burlington (CA); Peter Ian Macpherson, Beamsville (CA); Michael Aaron Jeske, Toronto (CA)

(73) Assignee: Hatch Ltd., Mississauga (CA)

( * ) Notice: Subject to any disclaimer, the term of this patent is extended or adjusted under 35 U.S.C. 154(b) by 194 days.

(21) Appl. No.: 12/793,932

(22) Filed: Jun. 4, 2010

(65) Prior Publication Data

US 2011/0133373 A1 Jun. 9, 2011

Related U.S. Application Data

(60) Provisional application No. 61/184,487, filed on Jun. 5, 2009.

(51) Int. Cl.
*B22D 41/12* (2006.01)

(52) U.S. Cl. ..... 266/44; 266/165

(58) Field of Classification Search ..... 266/44, 266/165

See application file for complete search history.

(56) References Cited

U.S. PATENT DOCUMENTS 4,389,191 A 6/1983 Lowe
4,834,346 A 5/1989 Heyer et al.
5,439,202 A * 8/1995 Scriven ..... 266/165
7,241,101 B2 7/2007 Bauer et al.
2011/0133373 A1* 6/2011 Leng et al. ..... 266/44

FOREIGN PATENT DOCUMENTS

DE 750015 12/1944
EP 0271476 6/1988

OTHER PUBLICATIONS

International Search Report and Written Opinion of PCT/CA2010/000859; Sep. 15, 2010; Kurtis Ulicny.

* cited by examiner

*Primary Examiner* — Scott Kastler
(74) *Attorney, Agent, or Firm* — Bereskin & Parr

(57) ABSTRACT

An apparatus for the removal and replacement of a lid on a metallurgical transport vessel such as a ladle or a torpedo car. The apparatus comprises a frame, means for supporting the frame such that the vessel may be moved into position thereunder, a linkage including at least one lifting member pivotally connected to the frame, and at least one actuator connected to the linkage. The actuator is operable to move the lifting member such that when the vessel is moved to a designated position below the apparatus, the lifting member can be moved by the actuator and linkage from a first position providing clearance above the vessel, through a curved path to an intermediate position where it engages the lid, providing a vertical lifting force and a horizontal hinge releasing force to the lid, and to a second position where the lid is raised to a sufficient height to clear the vessel. The lifting member may subsequently be moved back by means of the actuator and linkage through a reverse curved path to the first position, and thereby lower the lid back on to the vessel.

10 Claims, 4 Drawing Sheets

APPARATUS FOR REMOVAL AND REPLACEMENT OF A HINGED LID ON A METALLURGICAL TRANSPORT VESSEL

FIELD

The present subject matter pertains to metallurgical transport operations such as in the steelmaking industry. In particular it has to do with the temporary holding and transport of molten metal in ladles and other vessels fitted with hinged insulated lids. Most specifically, the subject matter comprises a novel alternate mechanism for the removal and subsequent replacement of such hinged lids on molten metal ladles, and other transport vessels such as torpedo cars.

BACKGROUND

The utility of incorporating an insulating lid onto a molten metal transport vessel is not new and is becoming increasingly common as its advantages become more widely known and its implementation becomes easier. These advantages can be summarized under the headings of better heat retention, reduced slag solidification and build up, and improved life of refractories. In elementary implementations, the lids are placed and removed by factory cranes whenever needed. Although achieving the aforementioned advantages, these implementations have the imposed drawbacks of reducing cycle times, and requiring crane resources that could be utilized elsewhere.

A known apparatus for removing and replacing a lid on a metallurgical ladle is described in U.S. Pat. No. 4,834,346 (Heyer et al.) The technology introduced therein is a hinged ladle lid system that requires minimal crane time and has minimal impact on cycle time. The system automatically removes/replaces a hinged insulating ladle lid in process as the ladle is in transit. The method employed to achieve this is a three finger structure that mates with corresponding lifting pins on the lid as the ladle moves underneath. The relative movement of the ladle car with respect to the fingers will remove or replace the lid depending on the direction of travel of the ladle car.

This technology, as set forth in Heyer et al., successfully addresses the aforementioned drawbacks of a standard insulated lid system but manifests another inherent limitation in its implementation. When the fingers are acting on the lid, the hinge design dictates a single orientation of the lid with respect to the fingers. Also, the lifting motion of the lid is driven by the movement of the ladle car itself. Consequently, each direction of travel of a ladle car is inexorably tied with a single lid action. For example a 'forward' ladle car movement can produce only a lid removal and 'reverse' ladle car movement can produce only a lid replacement. A 'forward' ladle car movement is defined such that the ladle hinge is trailing in the direction of movement. A 'reverse' ladle car movement is defined such that the hinge is leading in the direction of movement.

Accommodating this 'reverse' orientation scenario with retractable fingers as set forth in Heyer et al. results in unacceptable increases in cycle time and larger demands on plant space. This method requires the ladle to move under and past retracted fingers, come to a stop and reverse direction back through the now lowered fingers. After the lid is removed the ladle must again come to a stop beyond the fingers, reverse direction, and travel under and past the again retracted fingers to the process station. After returning from the process station, the same lengthy sequence of finger retractions and ladle reversals is needed to retrieve the lid.

A sideways ladle orientation, is one that occurs less frequently, but is also unable to be acted upon by the passive finger method of Heyer et al. A separate method has been used previously to address this situation. The solution employs a frame with hooks lowered and raised on cables. This method is only used in this sideways orientation situation as it relies on the positioning tolerance afforded by the lifting pins when in that orientation. Conversely, positioning tolerances required to use this method in other orientations are too tight for most applications.

For new plant constructions, ladle orientation/directionality issues can usually be avoided by developing the layout to accommodate the requirements of the normal non-retracted finger method. However space limitations remain a salient issue for all plants, and other ladle orientations/directions may not be avoidable, even in new plants.

In pre-existing steelmaking plants, space considerations are compounded by more prevalent occurrences of the ladle orientation challenges highlighted above. Thus it is desirable to have a supplemental method of automatically removing the lid that is not contingent on the directionality of the ladle car and/or orientation of the ladle, and that delivers this functionality swiftly and in a package requiring minimal plant space.

SUMMARY

In light of the foregoing background information, it is an aim of the inventors to provide a more versatile and efficient solution for the removal and replacement of the hinged lid on a ladle or other metallurgical vessels for temporary holding and transport of molten metal. Embodiments of the present invention are able to act in a smaller envelope and in all vessel orientations regardless of travel direction, such as those situations where retractable fingers and cabled hooks have previously been employed. Embodiments of the invention also perform this function more efficiently and with a much reduced cost to cycle time as compared with prior methods and apparatus.

To achieve this end a linkage driven by at least one actuator is utilized to simultaneously move specialized engagement fingers relative to a stationary vessel and in a direction travelling from the pouring lip towards the lid hinge. In this way, the relative movement of the engagement fingers with respect to the orientation of the lid is similar to that in a typical lift operation with stationary fingers and a moving vessel.

A rail borne vessel orientation is always the same with respect to the car and the rails it travels on at a given location. Because of this, and the fact that the linkage and fingers act upon a stationary vessel:

1. the direction in which it arrives at the lifting apparatus is not a requirement of operation; and
2. the orientation of the vessel at a given location is not a requirement of operation.

All that is required is that the mounting of the linkage and fingers at a particular location be oriented to match that of the vessel position at that location.

Advantageously, there are three fingers with unique profiles extending from the linkage which, when the linkage is actuated, move on an curved path of sufficient diameter to:

1. Provide clearance for the vessel to move into a remove/replace position.
2. Smoothly and effectively engage the lid lifting structures to generate.
   a. A vertical lifting force and;
   b. A smaller horizontal hinge releasing force.
3. Raise the lid to a sufficient height to clear the vessel and safely hold it there.

4. Ensure adequate alignment tolerances for the vessel when positioning for removal or replacement of the lid during all of the above.

The fingers' specialized profiles facilitate the actions described above as well as aid in captivating the lid once engaged to prevent undesired movement which would hinder the replacement of the lid. While holding a lid, the apparatus also has a retaining structure to captivate the lid in the fingers and a locking mechanism to maintain the holding position.

Therefore, in accordance with a first aspect, there is provided an apparatus for the removal and replacement of a lid on a metallurgical transport vessel. The apparatus comprises a frame, means for supporting the frame such that the vessel may be moved into position thereunder, a linkage including at least one lifting member pivotally connected to the frame, and at least one actuator connected to the linkage. The actuator is operable to move the lifting member such that when the ladle is moved to a designated position below the apparatus, the lifting member can be moved by the actuator and linkage from a first position providing clearance above the vessel, through a curved path to an intermediate position where it engages the lid, providing a vertical lifting force and a horizontal hinge releasing force to the lid, and to a second position where the lid is raised to a sufficient height to clear the vessel. The at least one lifting member may subsequently be moved back by means of the actuator and linkage through a reverse curved path to the first position, and thereby lower the lid back on to the vessel.

Advantageously, the apparatus includes three lifting members in spaced relationship to align with three lifting pins on the lid of the vessel. More advantageously, a single actuator is operable to move all three lifting members.

According to another aspect, an apparatus is provided in a metallurgical facility using a vessel with a lid having a disengageable hinge connection to the vessel, the lid being removable from the vessel by moving the lid upwardly and horizontally relative to the lid, and using a car on rails for transferring the vessel. The apparatus includes a frame, a linkage connected to the frame, at least one lifting member connected to the linkage, means for supporting the apparatus in a fixed position such that the car can park the vessel at a lifting position below the apparatus, and at least one actuator operable on the linkage to move the at least one lifting member from a first position in which it is clear of the lid of the vessel, through a curved path to an intermediate position in which it engages the lid of the vessel and lifts the lid upwardly and horizontally to release the hinge, to a second position in which it holds the lid securely above the vessel.

Advantageously, the lid of the vessel has at least three lifting pins in spaced relationship, and the apparatus has at least three corresponding lifting members in complimentary spaced relationship to concurrently engage the lifting pins. More advantageously, the apparatus has a single actuator operable to move the at least three lifting members.

According to yet another aspect, a method is provided for removing a lid from a metallurgical transport vessel, the lid having a rearwardly releasable hinged connection to the vessel, comprising the steps of:

moving the vessel by means of a car on rails to a position below a lid lifting apparatus;

actuating lifting members of the apparatus through a curved path by means of a linkage mechanism so as to engage the lid and move it upwardly and rearwardly to release the hinge, and to hold the lid securely in place above the vessel; and moving the vessel by means of the car to a position remote from the apparatus.

Advantageously, the curved path is in a vertical plane parallel to the rails.

BRIEF DESCRIPTION OF THE DRAWINGS

In order that the present subject matter may be more fully understood, reference will be made to the accompanying drawings in which.

DETAILED DESCRIPTION

Figure 1:
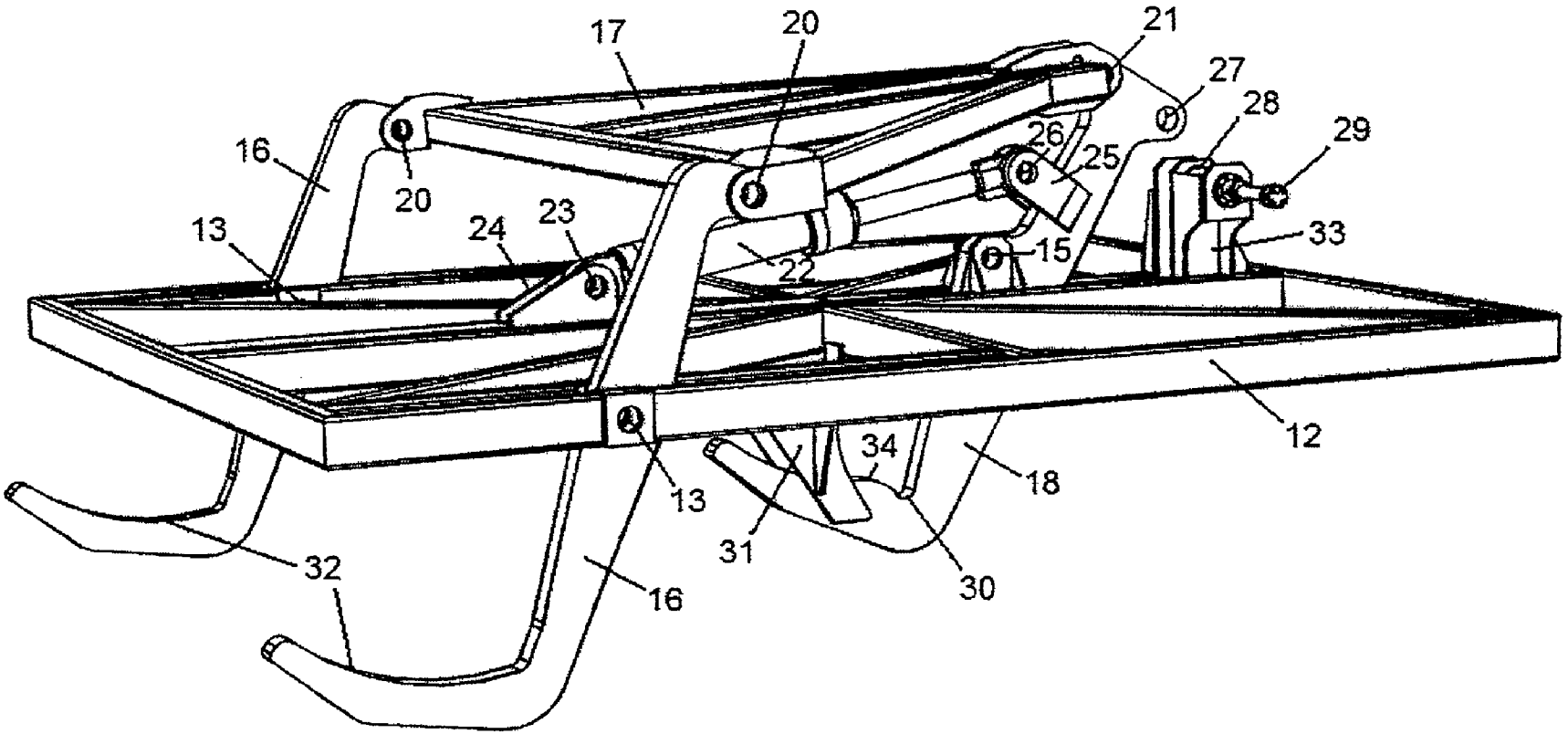
FIG. 1 is a perspective view of an apparatus according to one embodiment with the upper parts of the enclosing frame removed for clarity.
Figure 2:
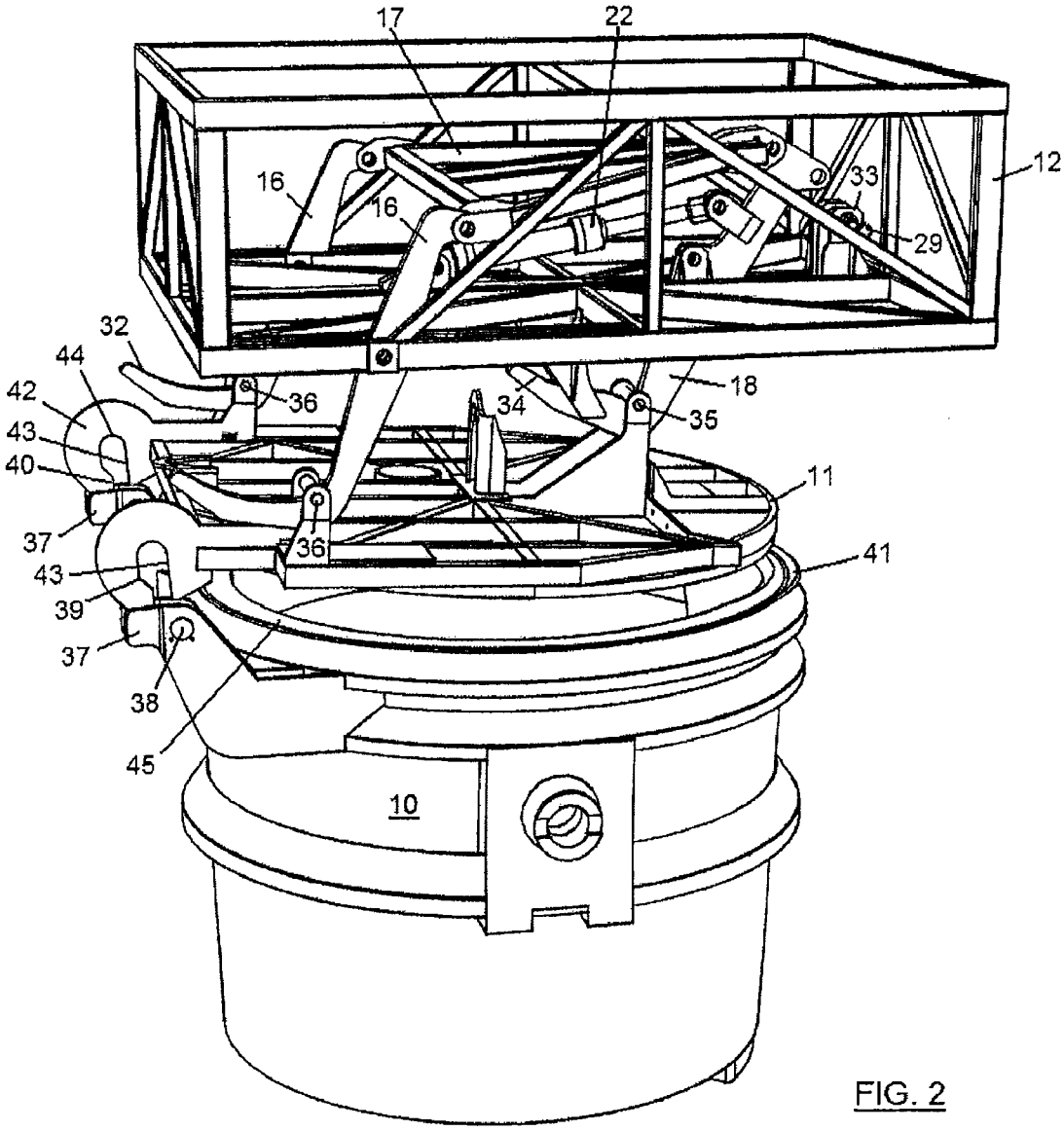
FIG. 2 is a perspective view of the same apparatus engaged and lifting the hinged ladle lid off of a ladle with retrofitted hinge pins.

The linkage employed in one exemplary embodiment can conceptually be reduced to a four bar linkage. Attention is drawn first to FIG. 1 which depicts an isolated view of the apparatus with the upper portion of the enclosing frame 12 removed for clarity. The bottom of the frame shown provides all of the connection points for the frame to the rest of the linkage. The rest of the frame 12 as shown in FIG. 2 provides rigidity and an enclosing structure for the apparatus.

The four members of the linkage are comprised of the frame 12, a joining A-frame member 17, two front lifting members 16 (which reduce to one conceptual member in the linkage), and a rear lifting member 18. The lifting members 16 and 18 are attached near their mid points to the frame 12 at pivot points 13 and 15. Similarly the lifting members 16, 18 are attached near their end points to the A-frame member at pivot points 20, and 21. The linkage is driven by a single actuator 22 that is located on the mid plane of the apparatus between the two front lifting members 16. The cylinder of the actuator 22 is mounted in a first clevis 24 and pivots about point 23, and its rod eye pivots at point 26 attached to a second clevis 25 which is located in a mid position between pivot points 15 and 21.

There is a locking mechanism built into the device which consists of a locking mechanism actuator 29 attached to a locking pin 28 supported in a housing 33 attached to the frame 12. The locking pin 28 is designed to engage in a locking hole 27 of the rear lifting member 18 when the actuator 22 is fully extended with the apparatus in the full up position. Additionally, a retaining structure 31 has been attached to the underside of the frame with supporting gussets. Once the surface of the rear lifting member 18 achieves a certain height, this retaining structure 31 captivates the rear lift pin 35 preventing any gross movement of the ladle lid. As the lid is lifted further the increasing angle on the engaging surface of the finger 34 of the rear lifting member 18 and the constriction of the retaining structure 31 guides the rear lift pin 35 into a seat 30 which acts to accurately position the lid 11 for the eventual replacement sequence.

The front lifting members 16 incorporate curved profiles on their engaging fingers 32 which are designed to present a shallow angled surface to the front lift pins 36 relative to the horizon for a smooth initial engagement and subsequent increasing lifting gradient. The rear finger 34 has similar tip profile but then deviates from that of the front fingers 32 in order to create the seat 30.

FIG. 2 shows a stationary ladle 10 with hinged lid 11 being acted upon by the apparatus at lifting pins 35 and 36. The rear lift pin 35 is shown already seated in the seat 30. The lifting fingers 32, 34 have moved in a direction pointing from the pouring lip 41 to the lid hinges 37 to engage the lift pins 35, 36 while the ladle is stationary. The ladle shown could have come to a stop under the lifting apparatus from any direction (left/right, or in/out of the page).

In contrast, the lift method described in Heyer et al. could only lift the lid shown in FIG. 2 as the ladle moved from the left of the page to the right (with fingers directed from the pouring lip 41 towards the hinges 37). A removal in the opposite direction (fingers directed from hinges 37 towards pouring lip 41 with ladle moving from right to left), would not be possible due to integral design elements in the hinge. For example, the hinge notch 39 would interfere with the vertical lifting of the lid in this case because the stationary lifting fingers would push the hinge notch 39 against the hinge pin 38 thereby impeding the subsequent vertical lift of the lid. Also, the long hinge surface 40 is designed to impinge on the hinge pin 38 during a lid replacement to align the lid and subsequently guide the hinge pin into the hinge slot 44. Stationary fingers engaging in the opposite direction as noted above would have to lift the lid clear of this surface 40 for the ladle to proceed to the process station. Hence, there would be no surface 40 to impinge upon to retrieve the lid as the ladle retraced its movement back from the process station.

Figure 3:
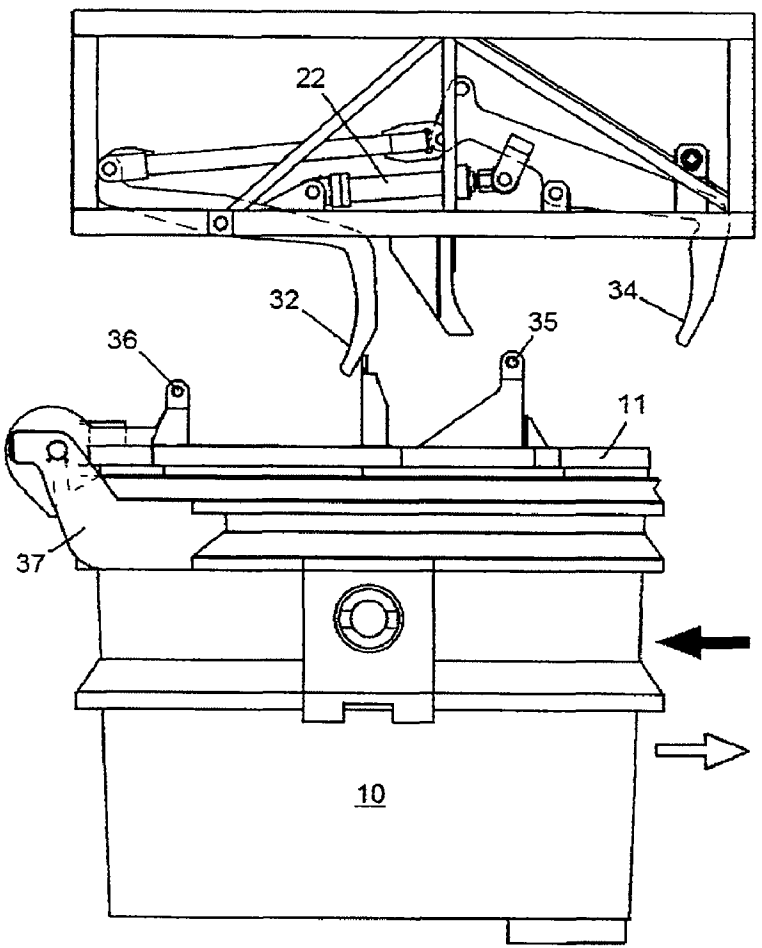

FIGS. 3-6 show the sequential steps of the lid removal, the replacement of the lid being a reversal of these steps. It should be noted that the orientation of all ladles with respect to the rails they travel on is consistent. Also, since the invention does not require a particular direction of approach, all cases can be satisfied. As an example, FIG. 3 depicts a ladle 10 with a lid 11 that has come to a stop at a lid removal location from the right side of the page (as indicated by the black arrow) en route to a process station off the page to the left. The fingers 32, 34 are fully retracted by the fully retracted actuator 22. This allows adequate clearance between the fingers 34, 32 and their corresponding lift pins 35, 36 on the lid 11 so that the ladle 10 can move unimpeded under the fingers 32, 34 and into the lift position.

Figure 4:
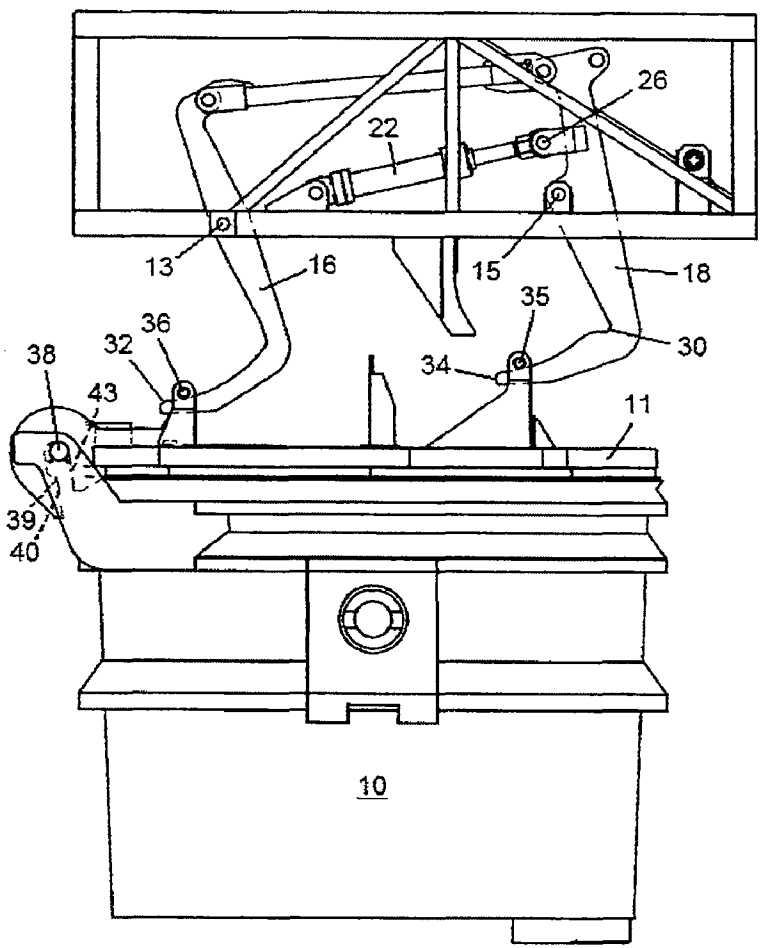
FIGS. 3, 4, 5 and 6 are side views depicting the sequential steps in the removal of the ladle lid by the same apparatus.

FIG. 4 shows the initial engagement of the fingers 32, 34 under the lift pins 36, 35. At this point the actuator 22 is at mid-stroke. The cylinder force applied to the clevis 26 on the rear lift member 18, causes it and the front lifting members 16 to pivot about points 15 and 13 respectively and simultaneously. This causes the fingers 32, 34 to trace arc shaped paths downward towards the lift pins 36, 35. The tips of the fingers 32, 34 approach the lift pins 36, 35 with a shallow angle between their surface and the horizon to minimize the initial impact with the pins 36, 35 and create a smooth lift on continued actuator 22 extension. It should be noted that the finger profiles and positioning here is such that a significant left-right or forward-back misalignment of the ladle 10 and/or lid 11 can be tolerated.

During the continued engagement and the creation of a vertical lifting force a smaller horizontal component of force is also created (from friction and a small but non-zero contact angle) that acts on the lift pins 35, 36. This force acts on the lift pins 35, 36 to push the short hinge surface 43 of the lid 11 against the hinge pin 38. This allows for a clean lift clear of the hinge notch 39 on the long hinge surface 40 as the hinge pin 38 slides along the short hinge surface 43 with increasing actuator 22 stroke.

Figure 5:
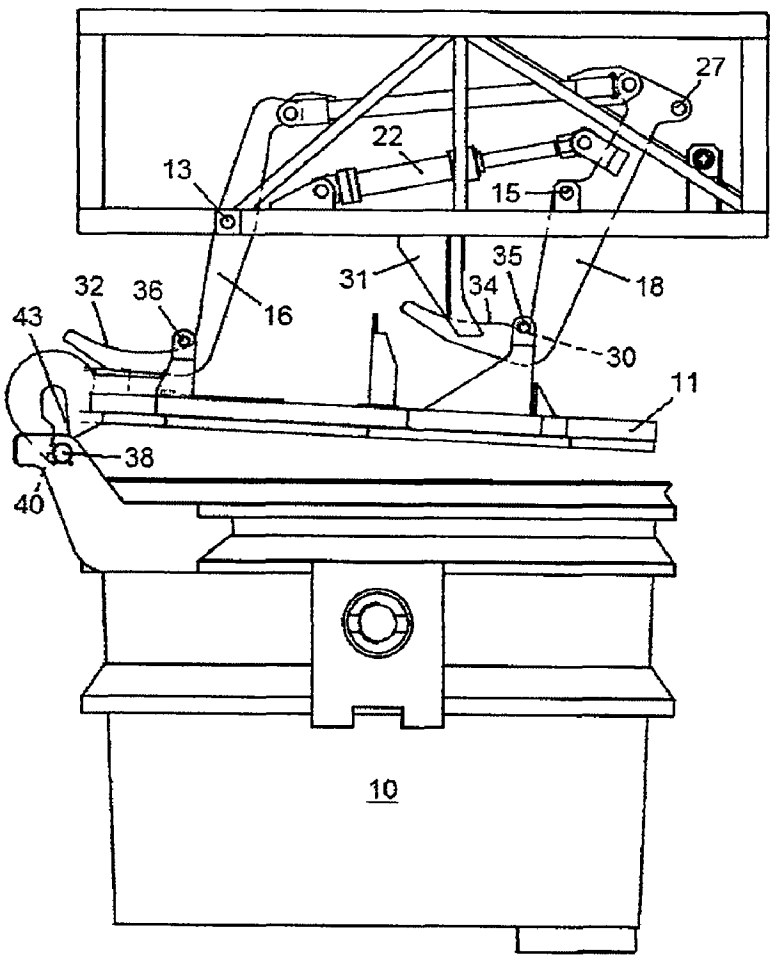

As the actuator 22 stroke increases from that shown in FIG. 4 towards that shown in FIG. 5, the lift pins 35, 36 roll along the surface of the fingers 34, 32 causing the lid 11 to lift vertically while being restrained horizontally by the short hinge surface 43 impinging on the hinge pin 38. It should be noted that the lift pins 35, 36 are mounted on bearings and so are able to roll along the lift fingers to reduce friction. While still being restrained horizontally by the hinge pin 38, the rear finger 34 passes the retaining structure 31 which captivates the rear lift pin 35 and eliminates the possibility of the lid 11 sliding off the fingers 32, 34. Shortly thereafter, with increasing actuator 22 stroke, the short hinge surface 43 becomes clear of the hinge pin 38 as shown in FIG. 5. At this point, the lid 11 is acted upon by the lifting apparatus alone, but the ladle 10 is not yet clear of the long hinge surface 40. Eventually the rear lift pin 35 slides into the seat 30 either by the increasing angle of the rear lift finger 34, or by the constriction of the retaining structure 31 with increasing actuator 22 stroke.

Figure 6:
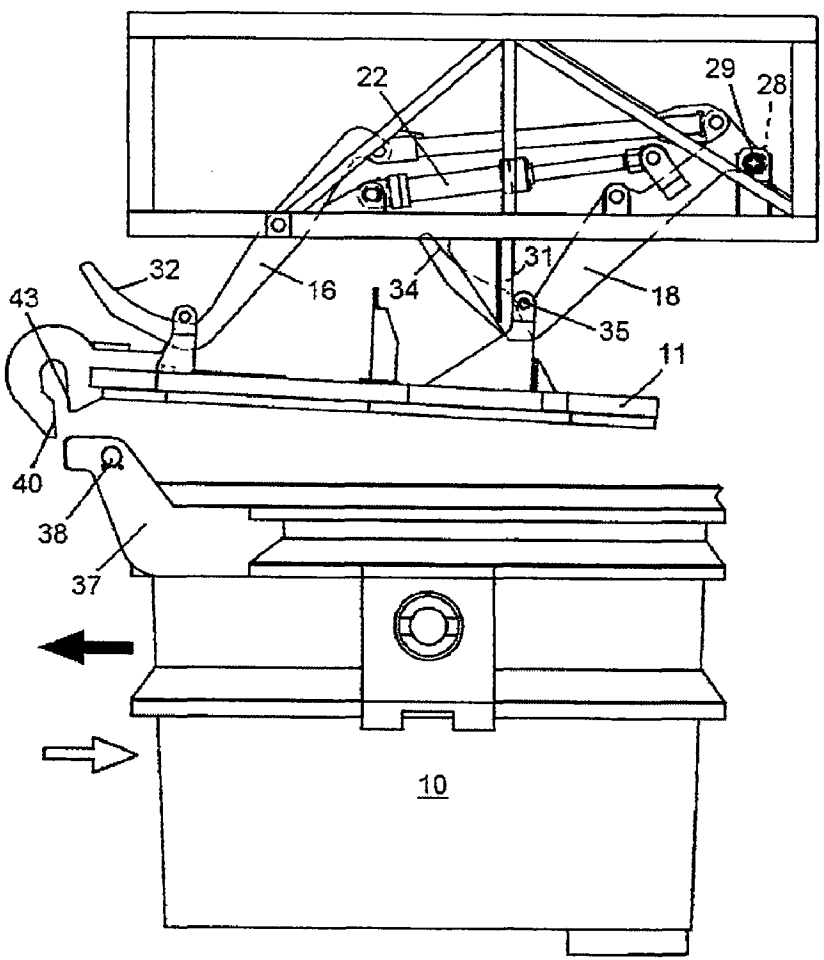

FIG. 6 shows the actuator 22 at full stroke. In this position, the long hinge surface 40 is clear of the hinge pin 38 allowing the ladle 10 an unencumbered path to the process station. The full up position also brings the locking hole 27 of the rear lifting member 18 into position to be secured by the pin 28 actuated by the hydraulic cylinder 29.

After the ladle 10 is finished at the process station, it retraces its path back to the lifting apparatus of FIG. 6 in the direction of the white arrow and in the orientation shown. The locking mechanism actuator 29 and locking pin 28 are released and the actuator 22 begins to retract lowering the lid 11 back towards the ladle 10.

Once the long hinge surface 40 makes contact with the hinge pin 38 as shown in FIG. 5, the lift pins 35, 36 begin to slide relative to the fingers 34, 32 as the actuator 22 continues to retract. As the lifting members 16, 18 pivot about points 13 and 15, the lid 11 is guided downward and into alignment with the ladle 10 by the sliding contact of the ladle hinge pin 38 along the long hinge surface 40. Finally the lid 11 is fully lowered onto the ladle 10 as shown in FIG. 4. The lift fingers 32, 34 are then retracted clear of the lift pins 35, 36 as shown in FIG. 3 and the ladle 10 is then free to move to its next process station with lid 11 in position in the direction indicated by the white arrow.

It will be apparent that various changes and modifications can be made to the invention outlined in the foregoing detailed description without departing from the scope of the invention as defined in the claims. For example, the actuator 22 can be of a functionally different type, such as a rotary actuator. It may also be possible to use a plurality of actuators acting on the lifting members simultaneously. Similarly, the locking mechanism could be implemented with a different means of actuation. The shape and construction of the linkage members can be of different embodiments. Also, the geometry of the linkage and lift fingers themselves can take on different embodiments to accommodate application differences such as vessel size and type, including torpedo cars and other metallurgical transport vessels.

The invention claimed is:

1. An apparatus for the removal and replacement of a lid on a metallurgical transport vessel, comprising:

a frame, installed such that the vessel may be moved into position thereunder;

a linkage including at least one lifting member, pivotally connected to the frame;

at least one actuator connected to the linkage, operable to move the lifting member such that when the vessel is moved into a designated position below the apparatus, the lifting member can be moved by the actuator and linkage from a first position providing clearance above the vessel, through a curved path to an intermediate position where it engages the lid, providing a vertical lifting force and a horizontal hinge releasing force, and to a second position where the lid is raised to a sufficient height to clear the vessel, and the at least one lifting member may subsequently be moved back by the actuator and linkage through a reverse curved path to the first position, and thereby lower the lid back on to the vessel.

2. The apparatus of claim 1, wherein there are three lifting members in spaced relationship to align with three lift pins on the lid of the vessel.

3. The apparatus of claim 2, wherein a single actuator is operable to move all three lifting members.

4. In a metallurgical facility using a vessel with a lid having a disengageable hinged connection to the vessel, the lid being removable from the vessel by moving the lid upwardly and horizontally relative to the vessel, and using a car on rails for transferring the vessel, an apparatus for removing the lid from the vessel, comprising:

a frame, located in a fixed position such that the car can park the vessel at a lifting position below the apparatus;

a linkage connected to the frame;

at least one lifting member connected to the linkage; and at least one actuator operable on the linkage to move the at least one lifting member from a first position in which it is clear of the lid of the vessel, through a curved path to an intermediate position in which it engages the lid of the vessel and lifts the lid upwardly and horizontally to release the hinge, to a second position in which it holds the lid securely above the vessel.

5. The metallurgical facility of claim 4 wherein the lid has at least three lift pins in spaced relationship and wherein the apparatus has at least three corresponding lifting members in complimentary spaced relationship to concurrently engage the lift pins.

6. The metallurgical facility of claim 5, wherein the apparatus has a single actuator operable to move said at least three lifting members.

7. A method for removing a lid from a metallurgical transport vessel, the lid having a rearwardly releasable hinged connection to the vessel, comprising the steps of:

moving the vessel by means of a car on rails to a position below a lid lifting apparatus;

actuating lifting members of the apparatus through a curved path by means of a linkage mechanism so as to engage the lid and move it upwardly and rearwardly to release the hinge, and to hold the lid securely in place above the vessel; and moving the vessel by means of the car to a position remote from the apparatus.

8. The method of claim 7, wherein the curved path is arcuate and in a vertical plane parallel to the rails.

9. The method of claim 7 wherein the vessel is maintained generally stationary during the step of actuating the lifting members to engage the lid and move it upwardly and rearwardly to release the hinge.

10. The method of claim 7, further comprising the steps of:

subsequently moving the vessel by means of the car back to a position below the apparatus;

actuating the lifting members of the apparatus through a reverse curved path so as to reconnect the lid to the hinge and move the lid downwardly and forwardly so as to replace the lid on the vessel and thereafter to disengage the lifting members from the lid; and moving the vessel by means of the car to a position remote from the apparatus.

* * * * *